US008113093B2

(12) United States Patent
Kistner

(10) Patent No.: US 8,113,093 B2
(45) Date of Patent: Feb. 14, 2012

(54) COMBINATION WRENCH SOCKET

(75) Inventor: Otwin Kistner, Kirschroth (DE)

(73) Assignee: GM Global Technology Operations LLC, Detroit, MI (US)

( * ) Notice: Subject to any disclaimer, the term of this patent is extended or adjusted under 35 U.S.C. 154(b) by 63 days.

(21) Appl. No.: 12/274,315

(22) Filed: Nov. 19, 2008

(65) Prior Publication Data

US 2009/0133541 A1 May 28, 2009

(30) Foreign Application Priority Data

Nov. 24, 2007 (DE) ..... 10 2007 056 637

(51) Int. Cl.
*B25B 13/06* (2006.01)
*B25F 1/04* (2006.01)

(52) U.S. Cl. ..... 81/124.5; 7/138

(58) Field of Classification Search ..... 81/124.4, 81/185, 119, 124.5, 125.1, 439; 7/138, 165
See application file for complete search history.

(56) References Cited

U.S. PATENT DOCUMENTS

| | | | | |
|---|---|---|---|---|
| 1,323,056 | A * | 11/1919 | Hofmann | 7/138 |
| 1,626,730 | A * | 5/1927 | Haynes | 81/185 |
| 3,298,261 | A | 1/1967 | Lynn | |
| 3,733,938 | A * | 5/1973 | Smith | 81/119 |
| 3,779,105 | A * | 12/1973 | Triplett et al. | 81/124.5 |
| 4,924,736 | A | 5/1990 | Bonner | |
| 6,109,142 | A * | 8/2000 | Learng | 81/124.5 |
| 6,332,382 | B1 | 12/2001 | Anderson et al. | |
| 6,928,906 | B1 * | 8/2005 | Marks | 81/185 |
| 7,150,209 | B1 | 12/2006 | Loomis et al. | |
| 7,252,022 | B1 | 8/2007 | Losee | |
| 7,387,051 | B1 * | 6/2008 | Chiang | 81/124.4 |
| 2001/0006014 | A1 | 7/2001 | Cowart et al. | |
| 2004/0211300 | A1 | 10/2004 | Wang | |

FOREIGN PATENT DOCUMENTS

| | | | |
|---|---|---|---|
| DE | 2117797 | | 10/1972 |
| DE | 9202273 | U1 | 6/1993 |
| DE | 9312609 | U1 | 12/1994 |
| DE | 20208490 | U1 | 10/2002 |
| DE | 10304246 | A1 | 8/2004 |
| DE | 102005051243 | A1 | 5/2007 |
| GB | 2390317 | A | 1/2004 |

OTHER PUBLICATIONS

Germany Patent Office, German Search Report for German Application No. 102007056637.0. Jan. 8, 2010.
English Patent Office, English Search Report for English Application No. GB 0821043.7, Mar. 9, 2009.

* cited by examiner

*Primary Examiner* — David B Thomas
(74) *Attorney, Agent, or Firm* — Ingrassia Fisher & Lorenz, P.C.

(57) ABSTRACT

A combination wrench socket is provided that includes, but is not limited to a one-piece outer part, in the form of a wrench socket having an inner part situated therein, a first tool head molded onto the inner part, and a second tool head, designed differently there from, molded onto the outer part, in which the outer part is designed in such a way that it has at least one retention element for the lockable fastening of a tool head.

5 Claims, 1 Drawing Sheet

COMBINATION WRENCH SOCKET

CROSS-REFERENCE TO RELATED APPLICATION

This application claims priority to German Patent Application No. 102007056637.0, filed Nov. 24, 2007, which is incorporated herein by reference in its entirety.

TECHNICAL FIELD

The invention relates to a tool and more specifically relates to a combination wrench socket.

BACKGROUND

Hand wrenches in the form of a combination hand tool, which are usable as screw drivers and as socket wrenches, are known, for example, from German published application DE 2 117 797. A hand tool is described here which, in addition to a screwdriver tip, has a socket wrench socket positively connected thereto, one being able to select which hand tool end is brought to use by axial displacement against the action of a coiled spring attached to the screwdriver shaft.

This combination known up to this point of differently dimensioned functional ends on a hand tool is already restricted in that it does not provide combining two functional ends for a machine-usable tool. In the present hand tool, a Phillips head screwdriver or a slotted screwdriver end or an outerly engaging functional end, such as a polygonal socket wrench end, may only be selected and brought to use manually. Furthermore, to use the screwdriver end, the socket wrench attachment must be displaced vertically each time manually against the coiled spring pushed onto the shaft for the friction lock between socket wrench end and screwdriver end, which on one hand represents a significant obstruction in normal use and on the other hand means that the socket wrench attachment always lies above the screw head as the tool is rotated, so that it is not possible to visually check the rotational movement and the snug fit of the tool. A machine-bound use is thus also not possible without further measures.

In view of the foregoing, at least one object of the invention is therefore to provide a combination attachment for machine screws which allows a combination of various socket-functional screw ends and is usable machine bound while concurrently improving the handling of the selected tool head. In addition, other objects, desirable features, and characteristics will become apparent from the subsequent summary and detailed description, and the appended claims, taken in conjunction with the accompanying drawings and this background.

SUMMARY

This at least one object, and other objects, desirable features, and characteristics, with a combination wrench socket is suggested according to the invention, comprising a one-piece outer part in the form of a wrench socket having an inner part situated therein, a first tool head molded on the inner part, and a second tool head, designed differently there from, molded onto the outer part, in which the outer part is designed in such a way that it has at least one retention element for the locking fastening of a tool head.

Using this configuration, advantageously, both a combination of various socket-functional tool heads may be provided and also the locking of the tool heads may be significantly improved by the design. The machine-bound use of the combination wrench socket is made possible by the selection of the various tool heads, which is no longer to be executed manually. In addition, a visual check is possible in machine use by the ability to lock the tool heads. Particularly for machine-driven manual screws, the combination wrench socket represents a significant simplification in the work sequence, because the present change of the unit functional wrench sockets is dispensed with, and/or a complete power screwdriver may be saved in large-scale use, because a manual change of wrench sockets is not typical therein for reasons of time.

The integrally designed outer part has devices for accommodation in a wrench system on its upper end. These may be implemented as a rectangle according to DIN 3121, for example.

In the combination wrench socket according an embodiment of the invention, the exterior side of the inner part and the interior side of the outer part may preferably be at least partially designed in such a way that a friction-locked connection may be produced. The torque transmission of the outer part to the inner part may be ensured by a hexagonal formfitting connection, for example. Using this advantageous embodiment, a reliable and long-lived torque transmission may be provided, which is connected with low production outlay.

In a further preferred embodiment of the invention, the first tool head may comprise a socket insert for Torx screws.

The second tool head may preferably alternatively or cumulatively comprise a socket insert for hex head screws. They may be implemented cylindrically for a specific size or also conically for a variable size of screws.

In a further preferred embodiment of the invention, the outer part may have two lateral oblong holes. The oblong holes may advantageously be used as a guide for the horizontal displacement of the inner part in relation to the outer part in connection with an inserted guide pin In a further preferred embodiment of the invention, the retention element may be implemented as a pin mechanism having a spring. The spring may preferably be a coiled spring. It retains the inner part in the starting position, while the pin secures and guides the inner part in relation to the outer part.

BRIEF DESCRIPTION OF THE DRAWINGS

The present invention will hereinafter be described in conjunction with the following drawing figures, wherein like numerals denote like elements, and.

DETAILED DESCRIPTION

Figure 1:
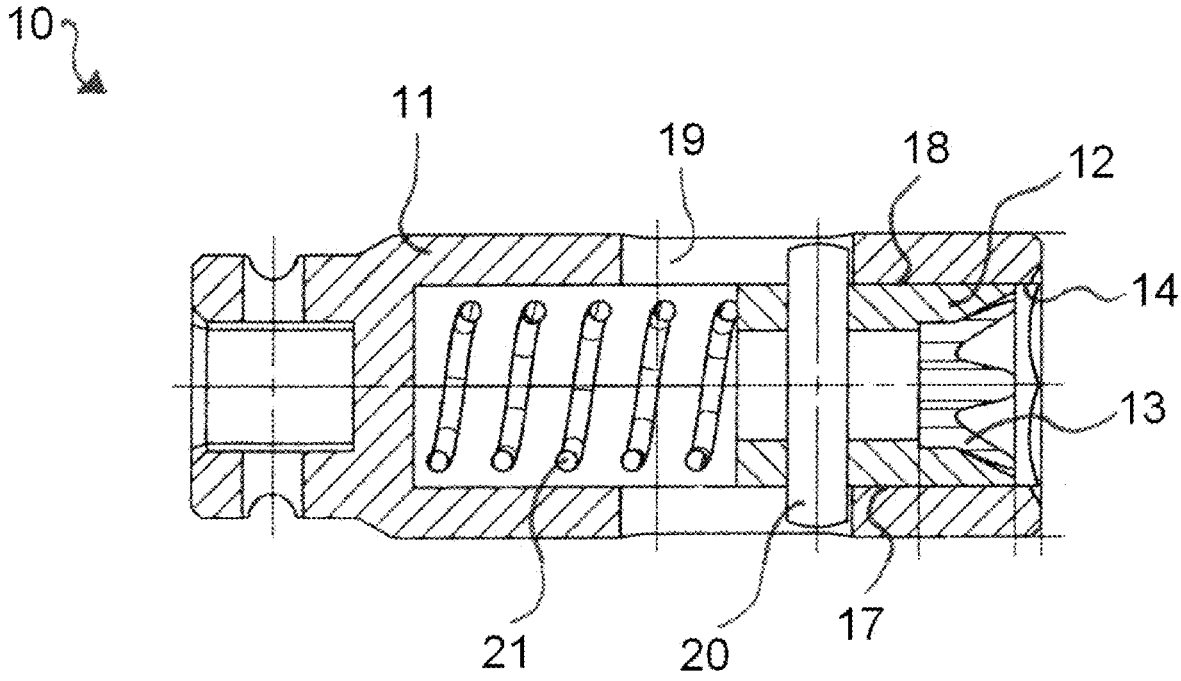
FIG. 1 shows a schematic cross-section of a combination wrench socket according an embodiment of the invention.

The following detailed description is merely exemplary in nature and is not intended to limit application and uses. Furthermore, there is no intention to be bound by any theory presented in the preceding summary or background or the following detailed description.

FIG. 1 shows a combination wrench socket 10 according to an embodiment of the invention in a schematic cross-sectional view. The outer part 11 is formed in one piece and has a rectangular recess on its upper end and a peripheral groove for accommodation in a wrench system. The inner part 12 is seated integrated in the outer part 11 and has a molded-on first tool head 13 in the form of a head for Torx screws on one end. The outer part 11, in contrast, has a molded-on second tool head 14 in the form of a hex wrench on its end. In the shaft area, the exterior side 17 of the inner part 12 and the interior side 18 of the outer part 11 may be designed in such a way that they form a formfitting connection. In this way, a long-lived and reliable torque transmission may be ensured. In the present case, this is achieved by a partially polygonal design of the particular sides 17 and 18, which are adapted to one another. The combination wrench socket 10 additionally has a lockable retention element 16 in the form of a pin mechanism 20 having a spring 21 in the embodiment of the invention shown. The pin may be inserted into a recess of the inner part. In addition, it may be horizontally displaced in a lateral oblong hole 19 of the outer part 11, so that an additional shift delimitation of the inner part 12 in relation to the outer part 11 results.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A combination wrench socket for use with a wrench, comprising a one-piece outer part comprising a first end and a second end, the first end being configured for stationary mating with the wrench;

a first oblong hole and a second oblong hole defined on opposing sides of the one-piece outer part and extending in a longitudinal direction;

an inner part positioned within the one-piece outer part;

a recess extending through the inner part in a traverse direction, perpendicular to the longitudinal direction;

a first tool head molded onto the inner part;

a second tool head designed differently from the first tool head molded onto the second end of the one-piece outer part; and a retention element adapted for a lockable fastening of at least one of the first tool head or the second tool head, the retention element comprising a pin mechanism extending through the first oblong hole, the recess, and the second oblong hole such that the inner part is configured to move relative to the one-piece outer part and the wrench in the longitudinal direction, and a spring positioned within the one-piece outer part and configured to bias the inner part relative to the one-piece outer part and the wrench in the longitudinal direction, wherein the spring is configured to bias the inner part forward towards the second end of the one-piece outer part.

2. The combination wrench socket according to claim 1, wherein the second tool head comprises a socket insert for hex head screws.

3. The combination wrench socket according to claim 1, wherein the second tool head is configured to receive a second tool within the one-piece outer part, and the first tool head is configured to receive a first tool within the inner part, and wherein, during engagement with the second tool, the second tool pushes the inner part against the bias of the spring and engages the second tool head.

4. A combination wrench socket for use with a wrench, comprising a one-piece outer part comprising a first end and a second end, the first end being configured for stationary mating with the wrench;

a first oblong hole and a second oblong hole defined on opposing sides of the one-piece outer part and extending in a longitudinal direction;

an inner part positioned within the one-piece outer part;

a recess extending through the inner part in a traverse direction, perpendicular to the longitudinal direction;

a first tool head molded onto the inner part;

a second tool head designed differently from the first tool head molded onto the second end of the one-piece outer part; and a retention element adapted for a lockable fastening of at least one of the first tool head or the second tool head, the retention element comprising a pin mechanism extending through the first oblong hole, the recess, and the second oblong hole such that the inner part is configured to move relative to the one-piece outer part and the wrench in the longitudinal direction, and a spring positioned within the one-piece outer part and configured to bias the inner part relative to the one-piece outer part and the wrench in the longitudinal direction, wherein an exterior side of the inner part and an interior side of the one-piece outer part are at least partially designed to produce a formfitting connection.

5. A combination wrench socket for use with a wrench, comprising a one-piece outer part comprising a first end and a second end, the first end being configured for stationary mating with the wrench;

a first oblong hole and a second oblong hole defined on opposing sides of the one-piece outer part and extending in a longitudinal direction;

an inner part positioned within the one-piece outer part;

a recess extending through the inner part in a traverse direction, perpendicular to the longitudinal direction;

a first tool head molded onto the inner part;

a second tool head designed differently from the first tool head molded onto the second end of the one-piece outer part; and a retention element adapted for a lockable fastening of at least one of the first tool head or the second tool head, the retention element comprising a pin mechanism extending through the first oblong hole, the recess, and the second oblong hole such that the inner part is configured to move relative to the one-piece outer part and the wrench in the longitudinal direction, and a spring positioned within the one-piece outer part and configured to bias the inner part relative to the one-piece outer part and the wrench in the longitudinal direction, wherein the first tool head comprises a socket insert for Torx screws.

* * * * *